US007699014B1

(12) United States Patent
Harrison

(10) Patent No.: US 7,699,014 B1
(45) Date of Patent: Apr. 20, 2010

(54) WATERCRAFT ANCHORING SYSTEM

(76) Inventor: Robert W. Harrison, 5844 Los Molinos Dr., Buena Park, CA (US) 90620

( * ) Notice: Subject to any disclaimer, the term of this patent is extended or adjusted under 35 U.S.C. 154(b) by 61 days.

(21) Appl. No.: 11/731,589

(22) Filed: Mar. 29, 2007

(51) Int. Cl.
*B63B 21/00* (2006.01)
*B63B 21/24* (2006.01)

(52) U.S. Cl. ..... 114/230.1; 114/230.2; 114/293

(58) Field of Classification Search ..... 114/230.1, 114/230.2, 293
See application file for complete search history.

(56) References Cited

U.S. PATENT DOCUMENTS 1,921,500 A * 8/1933 Blake ..... 441/3
2,863,415 A * 12/1958 Schofield ..... 114/295
4,960,064 A * 10/1990 Mestas et al. ..... 114/230.26
5,699,864 A * 12/1997 Dvorak et al. ..... 173/91
5,913,479 A * 6/1999 Westwood, III ..... 24/298
6,481,364 B2 * 11/2002 Woyjeck ..... 114/294
7,159,527 B2 * 1/2007 Nielsen ..... 114/230.2

* cited by examiner

*Primary Examiner*—Daniel V Venne
(74) *Attorney, Agent, or Firm*—Dennis W. Beech

(57) ABSTRACT

The present invention may be used for anchoring a watercraft. A mooring device may have a ground penetrating device attached at a first end of an elongated rod and a slide hammer attached at a second end of the elongated rod. A mooring line may be attached at a first end of the ground penetrating device and may be attachable at a second end to a boat and fixed in length by a rope lock.

16 Claims, 3 Drawing Sheets

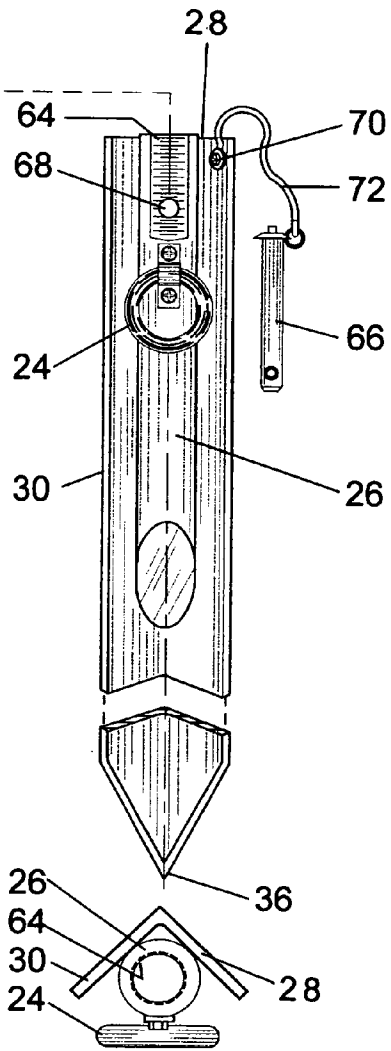
FIG. 3
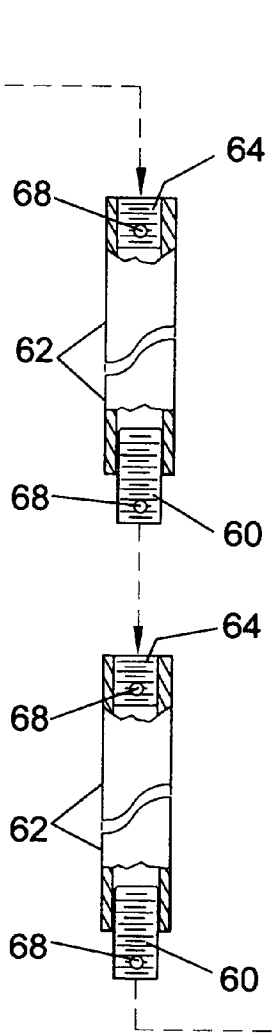
FIG. 2
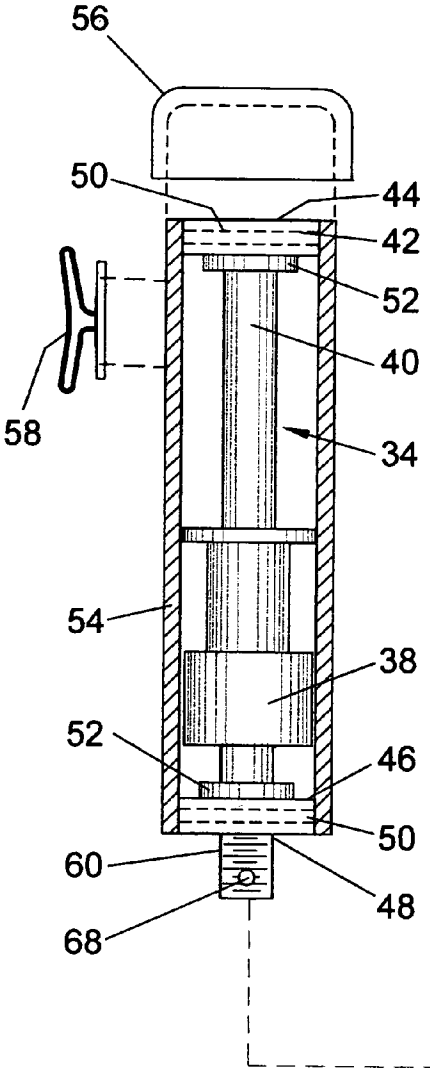

WATERCRAFT ANCHORING SYSTEM

BACKGROUND OF THE INVENTION

This invention relates to systems for anchoring a watercraft, for example, a boat, in shallow waters, such as near a shore line. The new anchor system has a ground penetrating element attached to an elongated rod for positioning the penetrating element in the bottom or underwater surface structure at a desired anchoring location.

Generally anchor systems for watercraft include a rope or chain with a metal anchor having arms, grapnel elements or mushroom disks that may be dropped in the water to sink to the bottom of a body of water. The anchor may be designed to catch on objects on the bottom or to resist dragging on the underwater ground material, for example a mud bottom of a lake or river. While easy to deploy, this type of anchor system may generally be unreliable in maintaining an anchoring in a desired location due to the bottom conditions. The anchor may therefore move due to wave wash against an anchored boat or for other reasons such as wind.

For permanent moorings often found in small boat harbors, a buoy tethered on a cable or chain may have a bottom embedded device that resists movement. Installing such generally permanent buoys may be a complicated operation and not be generally useful for a temporary mooring system for boat users who only wish to moor a boat for a short period of time at random locations such as adjacent a river or lake bank.

SUMMARY OF THE INVENTION

The present invention is directed to systems for anchoring a watercraft. A mooring device may have a ground penetrating device attached at a first end of an elongated rod and a slide hammer attached at a second end of the elongated rod. A mooring line may be attached at a first end to the ground penetrating device and may be attachable at a second end to a boat and fixed in length by a rope lock.

These and other features, aspects and advantages of the present invention will become better understood with reference to the following drawings, description and claims.

BRIEF DESCRIPTION OF THE DRAWINGS

FIG. 2 illustrates a partial sectional exploded view of an anchor mooring according to an embodiment of the invention;

FIG. 3 illustrates a top view of a stake according to an embodiment of the invention;

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
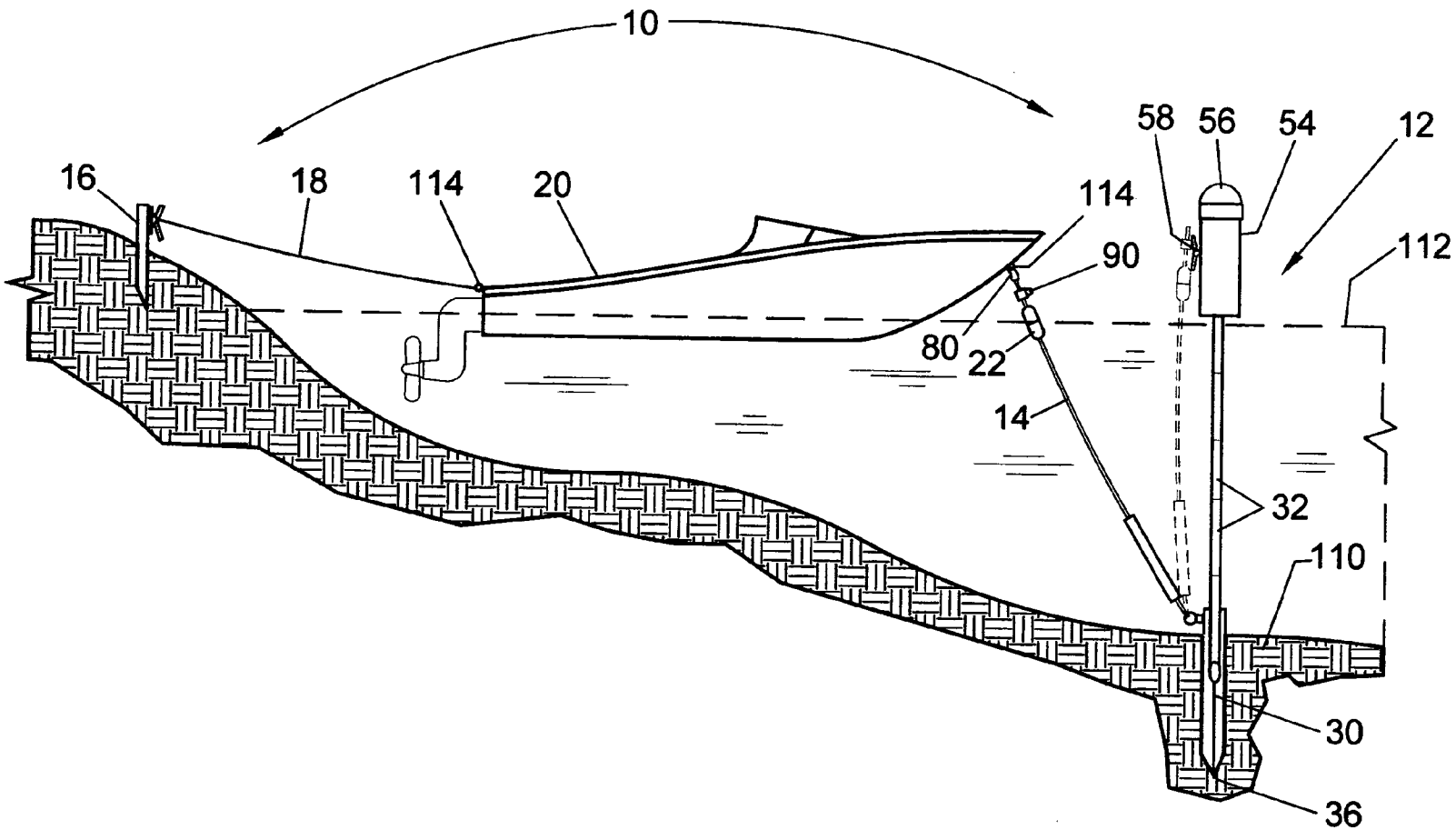
FIG. 1 illustrates a side elevation view of an anchor system according to an embodiment of the invention.
Figure 5:
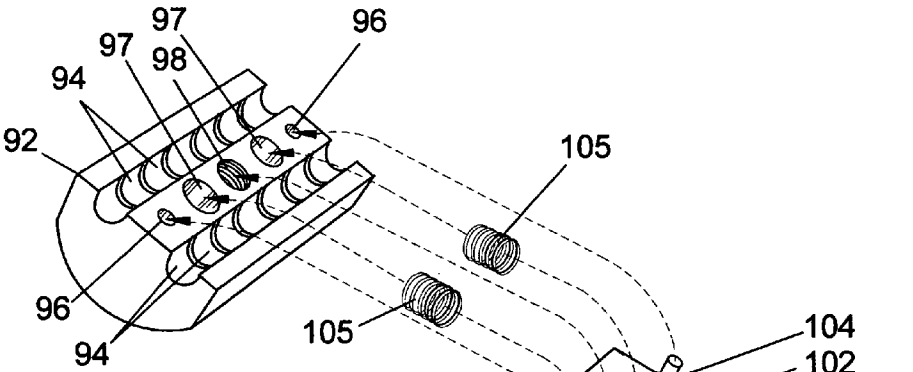
FIG. 5 illustrates an exploded view of a rope lock according to an embodiment of the invention.
Figure 6:
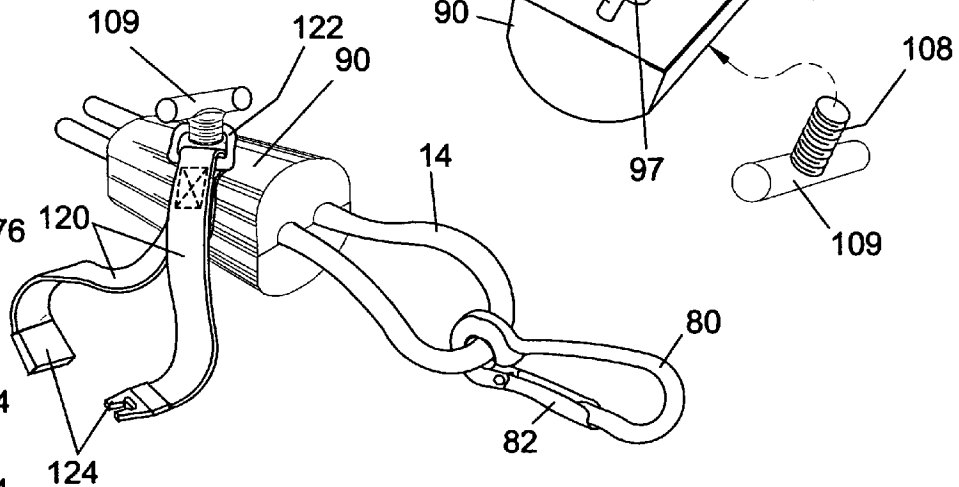
FIG. 6 illustrates a perspective view of a hook and rope lock according to an embodiment of the invention.
Figure 4:
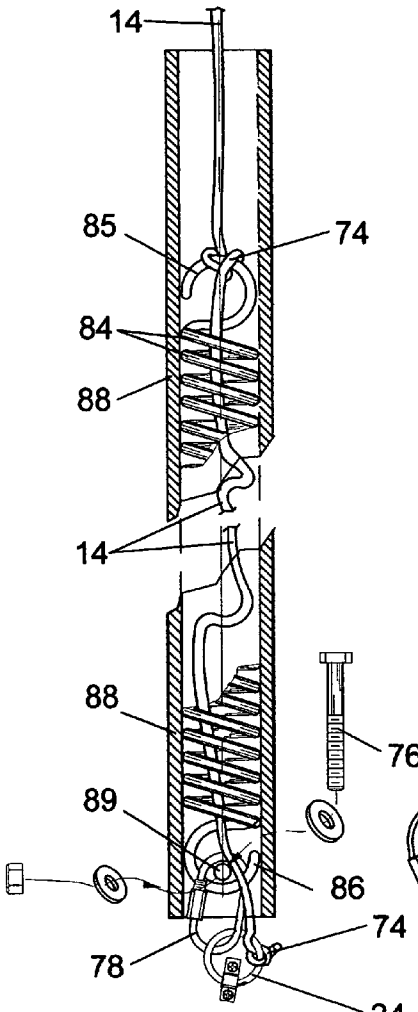
FIG. 4 illustrates an elastic connector and cross-section cover according to an embodiment of the invention.

Referring to FIGS. 1 through 3, a boat anchoring system 10 may have a mooring device 12, a mooring rope or line 14, a shore element 16 and a shore rope or line 18 for mooring a boat 20. The mooring device 12 may have a ground penetrating device or stake 30 with an elongated rod 32 attached. There may be a slide hammer 34 attached to the rod 32 at the end opposite the stake 30. The stake 30 may have a pointed end 36 to aid in penetrating an underwater ground structure 110. When the stake 30 may be positioned on the underwater ground structure 110, the slide hammer 34 may be used to drive the stake 30 in the ground structure 110. The slide hammer 34 may also be used to urge the stake 30 upward to extract it from the ground structure 110.

The slide hammer 34 may have a central rod 40 with an upper stop 42 attached adjacent an upper end 44 and a lower stop 46 attached adjacent a lower end 48 of the central rod 40. The stops 42, 46 may have a circular support element 50 of larger diameter than an impact element 52 that may be formed of metal. A hammer 38 may be slidably disposed on the central rod 40 to impact the stops 42, 46. A hollow cylindrical enclosure 54 may be positioned on the support elements 50 to enclose the slide hammer 34. A cap 56 may be position on the top of the enclosure 54. A cleat 58 may be attached to the enclosure 54 for storing the mooring rope 14 when it is not attached to a boat 20. The enclosure 54 may have reflective tape or other markings to function as an anchor marker buoy when positioned over the slide hammer 34.

The lower end 48 may have a downward extending rod insert 60 for insertion in and attachment to a rod element 62. The elongated rod 32 may be formed of multiple rod elements 62 attached end-to-end. The rod elements 62 may have a cavity 64 at one end and a rod insert 60 at the other end. The rod insert 60 may be attached in a cavity 64 by a threaded connection, by a pin 66 inserted through apertures 68 formed in the rod cavity 64 wall and the rod insert 60, or by other suitable method. The pins 66 may be attached to each element by a fastener 70 and line 72 as best viewed on stake 30. The number of rod elements 62 used may depend on the depth of the water to position the enclosure 54 above the water surface 112.

The stake 30 may be an angular bar construction with a flat upper end 28 and a pointed lower end 36. The stake 30 may have a solid rod 26 with a rod cavity 64 attached for receipt of a rod insert 60 that may be attached by a pin 66, threaded fittings or other suitable method. A ring 24 may be attached to the stake 30, for example, on the solid rod 26, for attachment of a mooring rope 14 or threaded fastener ring 78.

Referring to FIGS. 1 and 4 through 6, a mooring rope 14 may be looped through a hook 80 having a catch 82 for fastening to a boat ring 114 on the boat 20, for example, at the bow or stern end. The rope 14 at a first end may be fastened at the hook 80 by a rope lock 90. The second end of the rope 14 may be attached to an elastic element, such as a spring 84 at a first end 85. The spring 84 may be attached at a second end 86 to the ring 24 of the stake 30. A threaded fastener ring 78 may be used at the second end 86 for attachment to the ring 24. The second end of the rope 14 may be disposed through the spring 84 and attached to the spring first end 85 by a knot 74 and to the ring 24 by a knot 74 with slack in the rope 14 between the knots 74 to allow spring 84 to expand, but to limit the length of expansion.

A cylindrical cover sleeve 88 may be disposed on the spring 84. The spring 84 may be attached at the second end 86 by a nut and bolt fastener 76 disposed in cover sleeve aperture 89. The fastener ring 78 may also be attached to the nut and bolt 76. The fastener ring 78 may attach the cover sleeve 88 and spring 84 to the ring 24 that is attached to the stake 30.

The rope lock 90 may be formed of a first member 92 having two parallel rope grooves 94 formed therein. Intermediate the rope grooves 94 two guide pin cavities 96 and two spring cavities 97 may be disposed. Also, centrally disposed in the first member 92, intermediate the rope grooves 94, a threaded aperture 98 may be positioned. A rope lock 90 second member 100 may have a generally flat mating surface 102 for placement adjacent the rope grooves 94. The second member 100 may have guide pins 104 positioned for insertion in guide pin cavities 96 and two spring cavities 97 to be positioned opposite the spring cavities 97 of the first member 92 for retaining a lock spring 105 therebetween. A lock aperture 106 may be positioned centrally in the second member 100 for rotational insertion of a lock bolt 108 for threading engagement with the threaded aperture 98. The lock bolt 108 may have a knob 109, lever or the like to aid in tightening the lock bolt 108. The mooring rope 14 may also have a floatation device 22 attached in position to keep the hook end of the mooring rope 14 and the rope lock 90 on the surface of the water when not attached to the cleat 58, to a boat 20 or other object. There may be a strap 120 attached to a D-ring 122 that may be retained on the lock bolt 108 by the knob 109. The strap 120 may form a loop when closed by a quick release buckle 124. This strap 120 may be used to fasten excess mooring line 14 when not being used.

Referring to FIG. 1, the anchoring system 10 may also include a stake 16 as a shore anchoring element to which one end of a shore rope 18 may be attached. The stake 16 may be installed or removed from the ground structure 110 using slide hammer 34. The second end of the shore rope 18 may be attached to a boat ring 114, boat cleat or other boat structure. This may maintain the boat in a desired orientation and position for ease of access by user.

In an embodiment, a rod element 62 may be attached to the stake 30 having a threaded rod cavity 64 by threadable engagement of a rod insert 60. Other rod elements 62 and the slide hammer 34 may be attached using pins 66. This may allow removal of the slide hammer 34 and rod element 62 from attachment to the stake 30 by rotating the slide hammer 34 and rod elements 62 once the stake 30 is placed in the bottom of a body of water. This process may be implemented if a user may not want to display an anchor marker buoy represented by enclosure 54. The stake 30 may be removed by pulling upwardly on the mooring rope 14 when the rod elements 62 may have been removed.

While the invention has been particularly shown and described with respect to the illustrated embodiments thereof, it will be understood by those skilled in the art that the foregoing and other changes in form and details may be made therein without departing from the spirit and scope of the invention.

I claim:

1. A system for anchoring a watercraft comprising:

a mooring device having a ground penetrating device removably attached at a first end of an elongated rod and a slide hammer removably attached at a second end of said elongated rod;

said elongated rod is formed of a plurality of rod elements having a rod insert at a first end and a rod cavity at a second end;

said rod insert attached in said rod cavity of an adjacent rod element;

said slide hammer comprising a central rod having an upper stop adjacent an upper end and a lower stop adjacent a lower end, and a hammer slidably disposed on said central rod intermediate said upper stop and said lower stop;

an enclosure of hollow cylindrical form is disposed on said upper stop and said lower stop to enclose said slide hammer and a cap is disposed on said enclosure; and a mooring line attached at a second line end to said ground penetrating device and attachable at a first line end to a boat.

2. The system as in claim 1 wherein said ground penetrating device is a stake having a generally flat upper end, a pointed lower end, a solid rod attached thereto along a longitudinal axis, and a ring attached.

3. The system as in claim 1 wherein said rod insert is attached to said rod cavity by a pin inserted through an aperture in each of said rod inserts and said rod cavities.

4. The system as in claim 3 wherein said pin is attached to said rod element by a fastener and a line adjacent said aperture.

5. The system as in claim 1 wherein said upper stop and said lower stop have a circular support element and an impact element disposed for impact by said hammer.

6. The system as in claim 1 wherein a cleat is attached to said enclosure.

7. The system as in claim 1 wherein said mooring line at said second line end has an elastic device attached intermediate said ground penetrating device and said second line end.

8. The system as in claim 7 wherein said elastic device is a spring.

9. The system as in claim 8 further comprising:

a cover sleeve disposed on said spring with a second spring end of said spring attached to said cover sleeve by a fastener inserted through a sleeve aperture; and a threaded fastener ring attached to said fastener and said second spring end, and attached to a ring attached to said ground penetrating device.

10. The system as in claim 9 wherein said mooring line is inserted through said sleeve and said spring and said mooring line is attached at said first spring end and at said ring with an excess of line intermediate said first spring end and said ring.

11. The device as in claim 1 wherein said mooring line has a hook with a catch attached at said first line end and a flotation device attached adjacent said first line end.

12. The device as in claim 11 wherein attachment to said boat is by looping said mooring line through said hook attachable to a boat ring and fixing said mooring line with a rope lock.

13. The system as in claim 1 wherein a shore element has a stake with a shore line attached at one end to said stake and at a second end attachable to said boat.

14. The system as in claim 13 wherein said stake is attachable to said slide hammer.

15. The device as in claim 1 wherein said ground penetrating device is attached to said first end of said elongated rod by threaded engagement.

16. A method to allow mooring of a watercraft comprising:

a) attaching a ground penetrating device having a mooring line at a first end attached thereto to a first end of an elongated rod wherein said mooring line adjacent a second end of said mooring line is buoyant;

b) attaching a slide hammer to a second end of said elongated rod;

c) disposing said ground penetrating device in an underwater ground structure using said slide hammer; and d) detaching said elongated rod at said first end from said ground penetrating device.

* * * * *